United States Patent [19]

Frahme et al.

[11] 4,209,295

[45] Jun. 24, 1980

[54] FURNACE WITH HOMOGENEOUS REFRACTORY TUBULAR LINER

[75] Inventors: Carl E. Frahme; Gary E. Wygant, both of Valencia, Calif.

[73] Assignee: Industrial Insulations, Inc., City Of Industry, Calif.

[21] Appl. No.: 919,231

[22] Filed: Jun. 26, 1978

[51] Int. Cl.[2] ..... F27D 1/00

[52] U.S. Cl. ..... 432/247; 110/336; 432/158

[58] Field of Search ..... 432/247, 156, 158; 110/336

[56] References Cited

U.S. PATENT DOCUMENTS

| | | | |
|---|---|---|---|
| 1,829,320 | 10/1931 | White | 432/158 |
| 2,274,287 | 2/1942 | York et al. | 432/158 |
| 4,045,168 | 8/1977 | Abrial | 432/247 |

FOREIGN PATENT DOCUMENTS

| | | | |
|---|---|---|---|
| 2206535 | 2/1973 | Fed. Rep. of Germany | 432/247 |
| 1500720 | 2/1978 | United Kingdom | 110/336 |

*Primary Examiner*—John J. Camby

*Attorney, Agent, or Firm*—Sellers and Brace

[57] ABSTRACT

A high temperature furnace having an access opening and a thick-walled heat resistant lining comprising at least one homogeneous tubular member of multiple generally-tubular layers of vacuum deposited refractory fibers. Larger furnaces utilize two or more liner tubes in end-to-end abutment. The abutting ends may be rabbeted and internested to assure a heat barrier.

8 Claims, 2 Drawing Figures

FURNACE WITH HOMOGENEOUS REFRACTORY TUBULAR LINER

Figure 1:
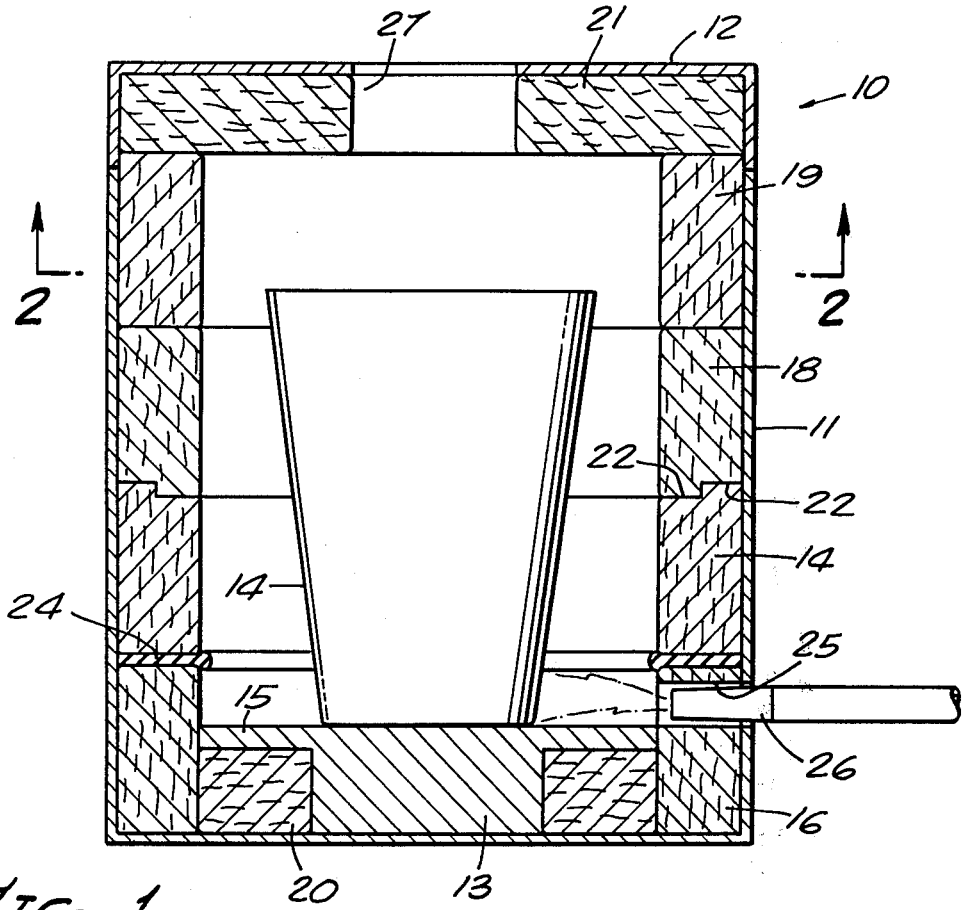

This invention relates to furnaces, and more particularly to an improved heat-resistant liner of one or more homogeneous tubes formed of vacuum-deposited generally-tubular layers of refractory fibers.

BACKGROUND OF THE INVENTION

Prior proposals and practices for lining crucible and the like type furnaces fall generally into two categories one of which utilizes preformed fire brick and the other castable or hydraulic cement. If fire bricks are used, these must be assembled within the chamber and suitably sealed to one another as by mortar. If hydraulic cement material is used, the chamber must be provided with a suitable form spaced inwardly from the chamber wall and into which freshly mixed hydraulic cementing material is poured. After the removal of the forms the cement is allowed to dry for an extended period after which it must be slowly heated at a safe rate permitting the remaining water to escape to the atmosphere without causing an explosion. Both prior types are objectionably heavy, have a high heat storage capacity, and objectionable high heat conductivity.

SUMMARY OF THE INVENTION

This invention avoids the serious shortcomings and disadvantages of prior insulative linings for smaller furnaces such as crucible furnaces, medium sized laboratory furnaces, and the like. This is accomplished by providing an economical lightweight thick-walled homogeneous refractory fiber tube having an exterior sized to have a snug conforming fit with the interior of the furnace chamber. The individual tubular liner modules are vacuum formed on a perforated mold assembly submerged in a dilute aqueous slurry comprising long refractory fibers and suitable binder materials. By long fibers is meant those having a length corresponding to or greater than those produced by the centrifugal spinning technique and known commercially as spun refractory fibers. Such fibers have a length averaging three to six inches or more in length. We have discovered that slurry having fibers of this length can be successfully used to produce refractory tubes and the like refractory modules having a wall thickness of at least three inches and as much as eight inches by vacuum deposition onto the perforated surface of a vacuum mold assembly. Modules having a wall thickness greater than two inches cannot be made by the vacuum molding technique using short fibers and such as those commonly produced by steam blown and similar techniques or using longer fibers which have been fragmented into short lengths before or during the slurry making operation. Tubular modules embodying the principles of the present invention are generally rigid, dimensionally stable, have a density of 10 to 12 lbs. per cubic foot and suitable for use as liners in chambers operating at temperatures between 1600 and 3,000° F.

Accordingly, it is a primary object of this invention to provide a crucible and laboratory-type furnace lined with one or more homogeneous tubular refractory liner modules.

Another object of the invention is the provision of a thick-walled tubular furnace liner module formed of multiple layers of vacuum deposited refractory fibers.

Another object of the invention is the provision of a light-weight thick-walled homogeneous tubular furnace liner having a density of 10 to 12 lbs. per cubic foot and suitable for use in chambers operating at temperatures between 1600° and 3,000° F.

These and other more specific objects will appear upon reading the following specification and claims and upon considering in connection therewith the attached drawing to which they relate.

Figure 2:
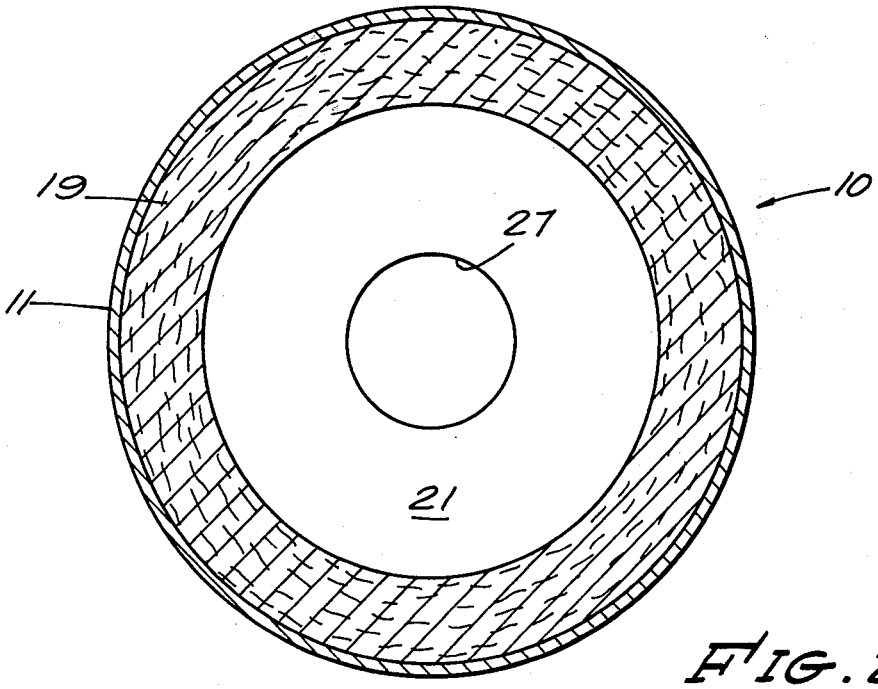

Referring now to the drawing in which a preferred embodiment of the invention is illustrated:

FIG. 1 is a vertical sectional view through a crucible furnace lined with the invention refractory fiber modules; and FIG. 2 is a cross-sectional view taken along line 2—2 on FIG. 1.

Referring to FIGS. 1 and 2, there is shown a crucible furnace 10 having a cup-shaped outer housing 11 and a detachable cover 12. A crucible support 13, commonly known in the art as a castable, is made of suitable material and placed beneath a crucible 14 for the material undergoing heat treatment or being melted. Castable 13 usually includes a radial annular ring 15 the periphery of which terminates adjacent the inner surface of the adjacent module of the furnace lining. The entire base of the furnace, including the burner opening, may be made from castable if severe mechanical abuse is expected, although this will have a slightly adverse effect on thermal efficiency.

The unique heat insulating lining for the furnace comprises homogeneous tubular modules 16, 17, 18, 19 and ring modules 20, 21 of similar wall thickness. It will be understood that each of these modules comprise multiple annular layers of long ceramic refractory fibers deposited one upon the other and interbonded at points of fiber cross-over using a perforated vacuum mold assembly submerged in an aqueous solution of the module constituents. We have discovered that it is critically important to employ fibers the majority of which are at least two and three inches in length or longer. Refractory fibers having a length corresponding to those produced by centrifugal spinning of the moltened refractory and known as spun fibers, or by other technique producing fibers of equivalent length, are readily accreted onto a vacuum mold assembly submerged in the slurry to provide modules having wall thicknesses ranging between three and eight inches. So far as known to us it has not been possible heretofore to vacuum mold refractory modules to thicknesses greater than about two inches, nor were we able to do so until we discovered it was possible to form such elements in thicknesses up to eight inches by using long refractory fibers, the majority of which have lengths averaging two to three or more inches in length.

These details and specific examples of slurry compositions providing high quality modules 3 to 8 inches thick and suitable for use in chambers operating at temperatures ranging between 1600° and 3000° F. are set forth in detail in our copending application for United States Letters Patent being filed concurrently herewith, Ser. No. 919,230, filed June 26, 1978, entitled Method of Making Thick-Walled Refractory Fiber Modules And The Product Formed Thereby and incorporated herein by reference. Upon removal from the mold assembly the individual modules are dried and then trimmed to size by band saws or the like. The opposite ends of the modules may be trimmed radially, or bevelled, or rabbeted as indicated at 22. The abutting ends of modules 18,19 are shown with radial end surfaces whereas the adjacent ends of modules 17,18 are formed with complemental internested rabbets 22,22. The axial shoulder of these rabbets provide a barrier preventing radiation of heat from the interior of the furnace to its housing which might otherwise occur owing to shrinkage of the interior portions of the liners under high temperature operating conditions. Another type of heat barrier comprises a resilient refractory fiber gasket ring 24 interposed between the adjacent ends of liner modules 16,17. Only the ring module 21 forming a liner for cover 12 need be attached to the cover by a suitable high temperature mortar or adhesive well known in this art or by mechanical means. The remaining modules however require no means holding them in assembled relation and merely have a snug fit with the interior surface of housing 11.

The furnace housing 11 and module 16 are provided with an opening 25 for one or more burners 26. Likewise, cover 12 and module 21 are normally equipped with a vent opening 27.

While the particular furnace with homogeneous refractory tubular liner herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

We claim:

1. That improvement in a high-temperature furnace having a tubular housing closed at one end and having an access closure at its other end, said improvement comprising a refractory lining for said housing comprising at least one homogeneous rigid tubular member formed of multiple generally annular layers of inter-bonded refractory fibers vacuum deposited from an aqueous suspension thereof to a wall thickness of at least three inches and having a density of the order of 10–12 pounds per cubic foot.

2. That improvement in a furnace defined in claim 1 characterized in that said refractory lining includes a plurality of said tubular members in end-to-end abutting contact, and said abutting adjacent ends of which are rabbeted to internest snugly with one another.

3. That improvement defined in claim 1 characterized in that said access closure is provided on the inner side thereof with a one-piece refractory liner of vacuum deposited refractory fibers.

4. That improvement in a furnace defined in claim 1 characterized in that tubular housing is supported in an upright position with said access closure uppermost, a rigid support at the bottom of said housing for material to be heated, and the major portion of the interior of said housing being covered by a refractory lining of said inter-bonded refractory fibers.

5. That improvement in a furnace defined in claim 1 characterized in that said refractory lining is retained in assembled position within said housing without retaining means interconnecting said lining and said housing.

6. That improvement in a furnace defined in claim 1 characterized in that said refractory fibers are spun ceramic refractory fibers.

7. That improvement in a furnace defined in claim 6 characterized in that, in general, said refractory fibers have a length ranging between three and six inches.

8. That improvement in a furnace defined in claim 6 characterized in that said refractory lining has a radial thickness of at least five inches.

* * * * *